US009944427B2

(12) United States Patent
Phung

(10) Patent No.: US 9,944,427 B2
(45) Date of Patent: Apr. 17, 2018

(54) PACKS FOR HOLDING FOOD ITEMS

(75) Inventor: Quang Phung, Deptford London (GB)

(73) Assignee: Rapid Action Packaging Limited, London (GB)

( * ) Notice: Subject to any disclaimer, the term of this patent is extended or adjusted under 35 U.S.C. 154(b) by 1525 days.

(21) Appl. No.: 11/718,363

(22) PCT Filed: Nov. 1, 2005

(86) PCT No.: PCT/GB2005/004206
§ 371 (c)(1),
(2), (4) Date: May 1, 2007

(87) PCT Pub. No.: WO2006/048622
PCT Pub. Date: May 11, 2006

(65) Prior Publication Data

US 2008/0308616 A1 Dec. 18, 2008

(30) Foreign Application Priority Data

Nov. 1, 2004 (GB) ..... 0424197.2

(51) Int. Cl.
*B65D 5/00* (2006.01)
*B65D 5/60* (2006.01)
*B65D 75/52* (2006.01)

(52) U.S. Cl.
CPC ..... *B65D 5/603* (2013.01); *B65D 75/525* (2013.01)

(58) Field of Classification Search
CPC ..... B65D 5/603; B65D 75/525
USPC ..... 229/117.27, 149, 902, 903, 938
See application file for complete search history.

(56) References Cited

U.S. PATENT DOCUMENTS

| | | | | |
|---|---|---|---|---|
| 662,969 | A | 12/1900 | Roth | |
| 1,135,878 | A * | 4/1915 | Christensen | 229/87.08 |
| 1,221,785 | A | 4/1917 | Williams | |
| 1,474,088 | A * | 11/1923 | Reynolds | 229/87.18 |
| 1,664,111 | A | 3/1928 | Johnson | |
| 2,107,946 | A | 2/1938 | Inman | |
| 2,282,207 | A * | 5/1942 | Palmer | 383/85 |
| 2,292,653 | A * | 8/1942 | Palmer | B65D 5/60 229/108 |

(Continued)

FOREIGN PATENT DOCUMENTS

| | | |
|---|---|---|
| AU | 5162379 | 4/1980 |
| DE | 299 03 316 | 5/1999 |

(Continued)

OTHER PUBLICATIONS

International Search Report; PCT/GB2005/004206; M. Vesterholm; dated Jan. 25, 2006.

(Continued)

*Primary Examiner* — Peter Helvey
(74) *Attorney, Agent, or Firm* — Fish & Richardson P.C.

(57) ABSTRACT

The disclosure relates to a pack for holding a food item or items comprising a bag (10) and a channel shaped holder (11) for the bag formed in card and comprising a pair of side walls (12,15) to which the sides of the bag are adhered by adhesive areas (40) and a base (14) hinged at first fold lines (21) to the side walls and having a plurality of spaced second fold lines (22) extending parallel to the first fold lines to allow the base to take up a generally convex or concave shape with the side walls of the holder spaced apart and holding the side walls of the bag apart.

7 Claims, 8 Drawing Sheets

(56) References Cited

U.S. PATENT DOCUMENTS

| | | | | | |
|---|---|---|---|---|---|
| 2,354,098 | A | * | 7/1944 | Bamber | B65D 5/02 229/124 |
| RE23,096 | E | * | 4/1949 | Mullinix | 229/87.11 |
| 2,553,923 | A | * | 5/1951 | Lambert | 242/160.1 |
| 2,835,435 | A | * | 5/1958 | Mullinix | 229/87.05 |
| 2,870,023 | A | * | 1/1959 | Vogt | 426/119 |
| 2,913,161 | A | | 11/1959 | Travis | |
| 2,987,402 | A | * | 6/1961 | Dold | 426/106 |
| 3,142,430 | A | | 7/1964 | Meyers | |
| 3,250,454 | A | | 5/1966 | Steiger | |
| 3,272,423 | A | * | 9/1966 | Bjarno | 383/90 |
| 3,339,721 | A | | 9/1967 | Goldstein | |
| 3,357,631 | A | | 12/1967 | Aid et al. | |
| 3,399,818 | A | * | 9/1968 | Stegner | 229/117.32 |
| 3,428,235 | A | | 2/1969 | Randazzo | |
| 3,515,333 | A | * | 6/1970 | Heiti et al. | 206/395 |
| 3,627,541 | A | * | 12/1971 | Farquhar | 26/394 |
| 3,964,669 | A | * | 6/1976 | Sontag et al. | 220/62.13 |
| 4,312,451 | A | | 1/1982 | Forbes, Jr. | |
| 4,313,542 | A | | 2/1982 | Roberts et al. | |
| 4,477,014 | A | | 10/1984 | Brandenburger | |
| 4,478,351 | A | * | 10/1984 | Homma | 229/117.32 |
| 4,484,683 | A | * | 11/1984 | Werner, Jr. | 229/101.2 |
| 4,494,785 | A | * | 1/1985 | Song | 294/25 |
| 4,575,000 | A | * | 3/1986 | Gordon et al. | 229/87.11 |
| 4,754,914 | A | * | 7/1988 | Wischusen, III | 229/87.08 |
| 4,930,639 | A | | 6/1990 | Rigby | |
| 5,028,147 | A | * | 7/1991 | Graham | 383/119 |
| 5,326,022 | A | | 7/1994 | Green | |
| 5,330,099 | A | | 7/1994 | Beales et al. | |
| 5,337,951 | A | * | 8/1994 | Roccaforte | 229/186 |
| 5,921,681 | A | * | 7/1999 | Money | 383/119 |
| 5,964,161 | A | * | 10/1999 | Conway | 108/43 |
| 6,234,384 | B1 | * | 5/2001 | Capy et al. | 229/87.03 |
| 6,335,042 | B1 | * | 1/2002 | Money | 426/106 |
| 6,360,941 | B1 | | 3/2002 | Larsson | |
| 6,401,927 | B1 | * | 6/2002 | Sorensen et al. | 206/562 |
| 6,431,365 | B1 | | 8/2002 | Money | |
| 6,637,646 | B1 | * | 10/2003 | Muise et al. | 229/117.01 |
| 6,695,202 | B2 | | 2/2004 | Miess | |
| 6,702,178 | B2 | * | 3/2004 | Bowers et al. | 229/87.08 |
| 7,143,930 | B2 | | 12/2006 | Money et al. | |
| 2007/0051784 | A1 | * | 3/2007 | Money | B65D 5/2028 229/115 |

FOREIGN PATENT DOCUMENTS

| | | |
|---|---|---|
| FR | 1 188 389 | 9/1959 |
| FR | 1 339 852 | 10/1963 |
| FR | 1 535 316 | 6/1968 |
| FR | 2 110 568 | 6/1972 |
| GB | 1 019 065 | 2/1966 |
| GB | 1 313 950 | 4/1973 |
| GB | 2 043 595 | 10/1980 |
| GB | 2 087 357 | 5/1982 |
| GB | 2 221 449 | 2/1990 |
| GB | 2 342 343 | 4/2000 |
| GB | 2349634 A | 8/2000 |
| GB | 2 372 491 | 8/2002 |
| GB | 2 377 421 | 1/2003 |
| GB | 2 386112 | 9/2003 |
| JP | 21939 | 2/1980 |
| JP | 2001114297 | 4/2001 |
| WO | WO99/25618 A | 5/1999 |
| WO | WO 02/34629 | 5/2002 |

OTHER PUBLICATIONS

International Search Report; PCT/GB96/01941; dated Dec. 16, 1996; A. Zanghi.
Office Action (translation and original); JP 509021/1997.
International Search Report; PCT/GB 03/05414; H. Segerer; dated Mar. 15, 2004.

* cited by examiner

PACKS FOR HOLDING FOOD ITEMS

This invention relates to packs for holding food items and is particularly or although not exclusively applicable to packs suitable for sale of items known as "fast food" in which burgers, rolls and the like are prepared to a customer's request and packed and sold at the point of sale.

Our International Patent Application No. WO 97/070737 discloses a pack for articles of food or other merchandise comprising a paper or film bag and a carton formed for supporting a lower part of the bag. The carton comprises a base with a centre fold line and walls hinged to the base along a further fold line to enable the carton and bag to be folded flat and to be erected to open the bag. The side walls of the lower part of the bag are secured to the side walls of the carton so that when the carton is erected by opening the folded base into a V form, the bottom part of the bag is open and as the V form is progressively widened, the bag is tensioned as the walls move apart until the base of the carton moves "over centre" and inverts to hold the lower part of the bag open.

This invention provides according to a first concept a pack for holding a food item or items comprising a bag and a channel shaped holder for the bag formed in card and comprising a pair of side walls to which the sides of the bag are adhered and a base hinged at first fold lines to the side walls and having a plurality of spaced second fold lines extending parallel to the first fold lines to allow the base to take up a generally convex or concave shape with the side walls of the holder spaced apart and holding the side walls of the bag apart.

For example the second fold lines in the base may comprise a central fold line and intermediate fold lines disposed midway between the central fold line and fold lines between the base and side walls so that the base can take up a generally even convex or concave shape between the side walls of the holder.

Preferably the bag when flat is longer than the channel and is secured in the channel with portions of the bag extending beyond either end of the channel.

In any of the above arrangements, one side wall of the holder may be extended to provide a lid having a fold line with the top of the side wall to enable the lid to be folded over the top of the channel to close the upper end of the bag disposed within the channel.

In the latter arrangement the lid may terminate in a flap having a fold line with the lid to enable the flap to be folded downwardly alongside the other side wall of the channel, means being provided for securing the flap to the other side wall to hold the lid closed over the channel and back.

More specifically the means to hold the flap of the lid in engagement with the other side wall of the channel may comprise a tab on the flap which is shaped to engage and lock in a slot in said other side wall.

For example the tab may be formed within the perimeter of the flap by a slit in the flap.

In the case where the holder includes a lid for the pack, the lid may be formed with a plurality of spaced fold lines to enable the lid to adopt a generally convexly curved form.

In the latter arrangement the lid may have a central fold line extending parallel to the fold lines between the lid and side wall and the lid and intermediate fold line on either side of the central fold line.

In accordance with a further arrangement in which the holder includes a lid, the side of the pack adjacent the side wall of the holder on which the lid is formed extends over the underside of the lid and is adhered to the lid to fold over the top of the bag with the lid.

In the latter case the other side of the bag extends above the side wall to which it is adhered to provide a flap which can be folded over the contents of the bag when the bag is closed.

The invention also provides a second concept comprising a container for a food product comprising an open topped bag and a channel shaped holder for the bag formed in card having a pair of side walls adhered to the sides of the bag and a base wall having convex fold lines with the side walls and a straight central fold line so that the base can snap "over centre" into an inverted V form to hold the side walls of the channel apart and thereby the spread the bag open, wherein the convexly curved fold lines extend generally parallel to one another at the ends of the fold lines to form corner regions when the holders folded into the channel form on which the holder can sit.

In the latter case the convexly curved fold lines between the base and side walls may have reverse curvature portions at the end regions of the lines.

More specifically the reverse curvature portions at the end regions of the fold lines may terminate in short parallel fold lines.

In any of the above arrangements where a channel shaped holder is provided wherein one of the side walls of the channel is extended to form a lid having a fold line with the side wall to allow the lid to be folded over the top of the channel to close the channel and means are provided for locking the lid to the other side wall of the channel to fold the lid in a closed position.

In the latter construction the means for locking the lid to the channel may comprise a tab on the upper end of said other side wall and a slot adjacent the free edge of the lid in which the tab is engageable.

According to a further feature the side wall of the bag adjacent the side of the channel on which the lid is formed may be extended over the underside of the lid and is adhered to the underside of the lid to form part of the closure over the upper end of the bag when the lid is folded into engagement with the other side of the panel.

In any of the above arrangements relating to the further concept of the invention wherein the bag is longer than the channel and is secured in the channel with end portions of the bag projecting beyond the ends of the channel.

The following is a description of some specific embodiments of the invention, reference being made to the accompanying drawings in which.

Figure 1:
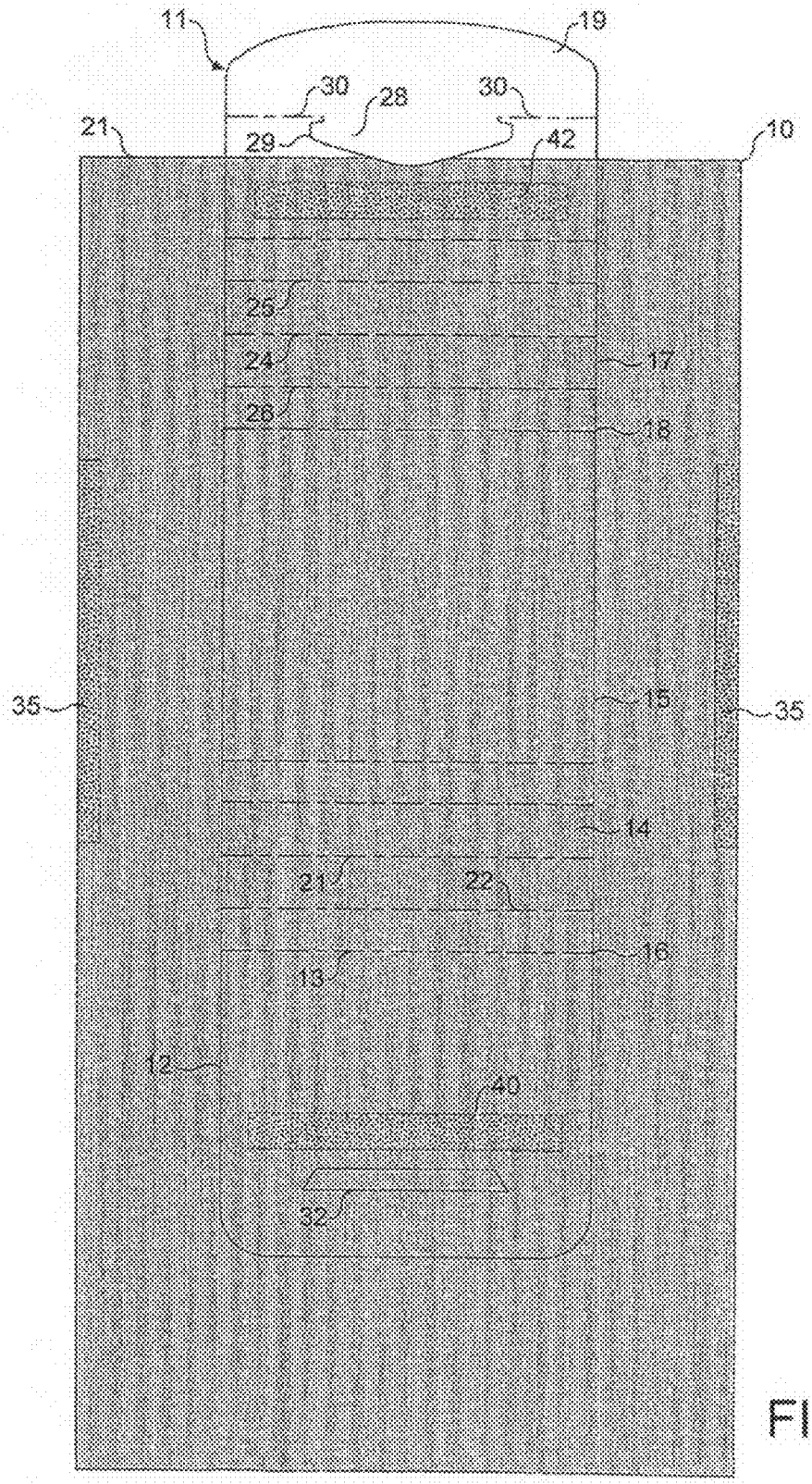
FIG. 1 is a front view of a pack in flattened form for a food item such as a roll.

Referring firstly to the embodiments of FIGS. 1 to 5, there is shown a pack for food items such as a filled roll comprising an open top paper bag indicated at 10 which is located in a holder formed in card indicated at 11. The holder comprises a one-piece strip of card and comprises a front wall 12 hinged by a fold line 13 to a bottom wall 14. A back wall 15 is hinged by a fold line 16 to the bottom wall and a lid 17 is hinged by a fold line 18 to the back wall. Finally a closure flap 19 is hinged by a fold line 20 to the lid.

Figure 3:
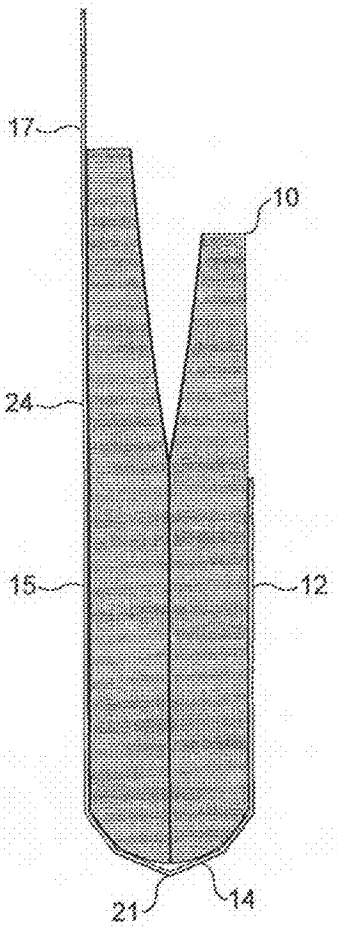
FIG. 3 is a side view of the pack with the lid open ready to receive a roll.
Figure 2:
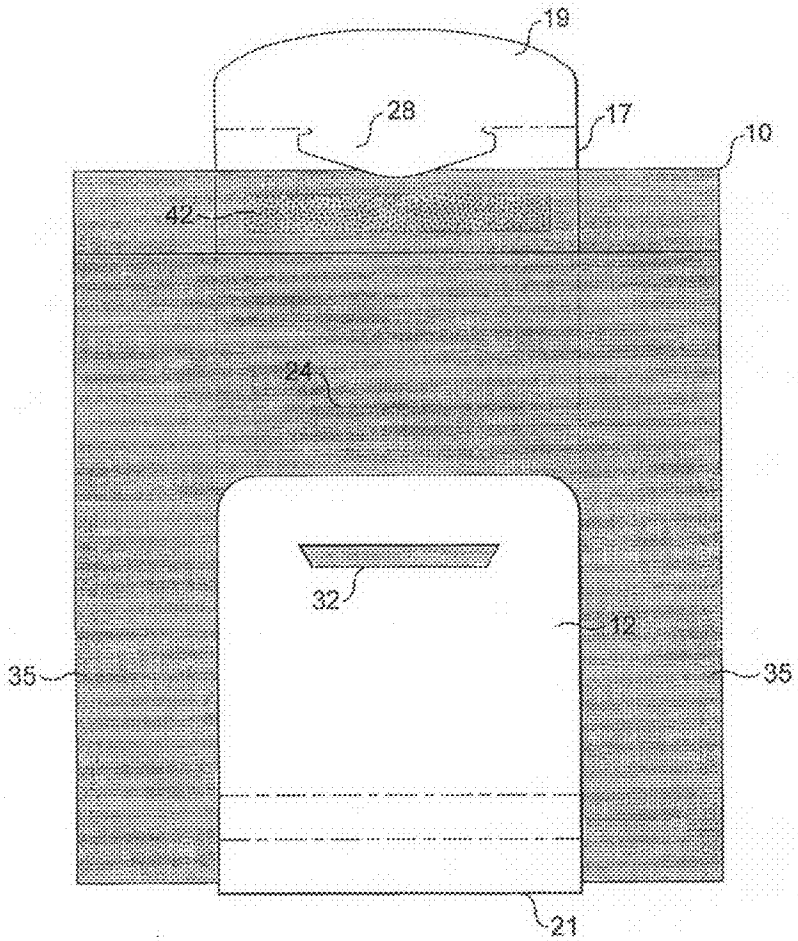
FIG. 2 is a front view of the pack opened out ready to receive a roll with the lid open.
Figure 4:
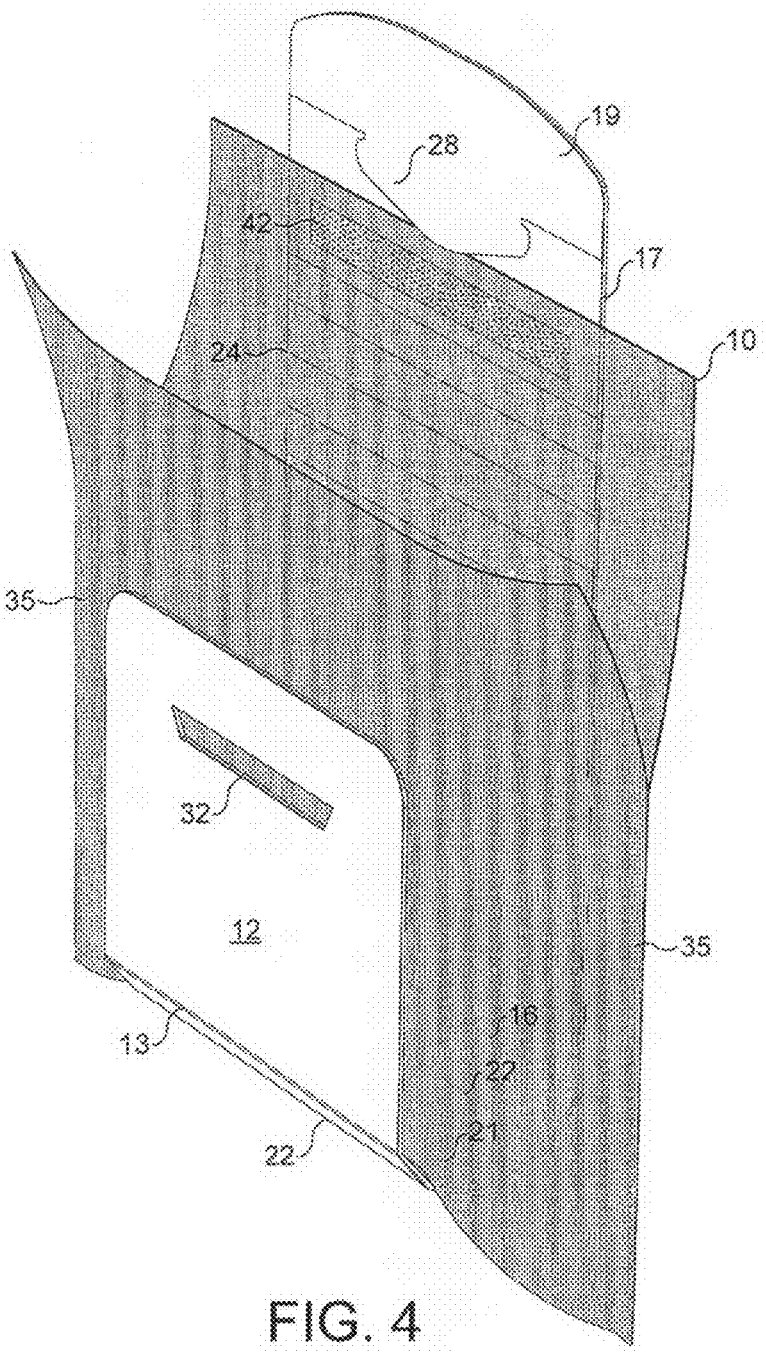
FIG. 4 is a perspective view of the pack with the lid open.
Figure 5:
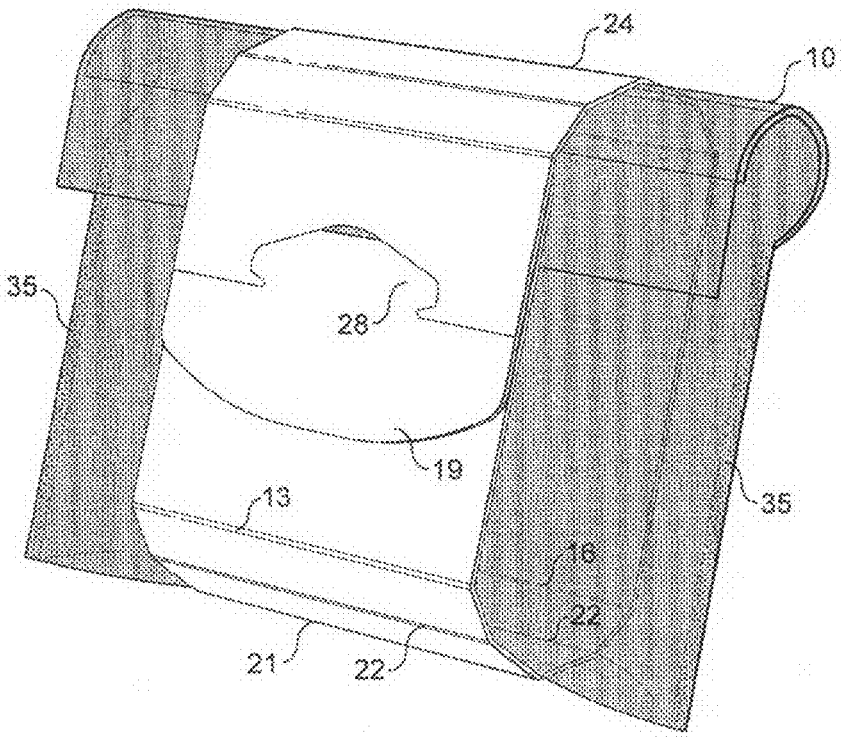
FIG. 5 is a perspective view of the pack with the lid closed.
Figure 6:
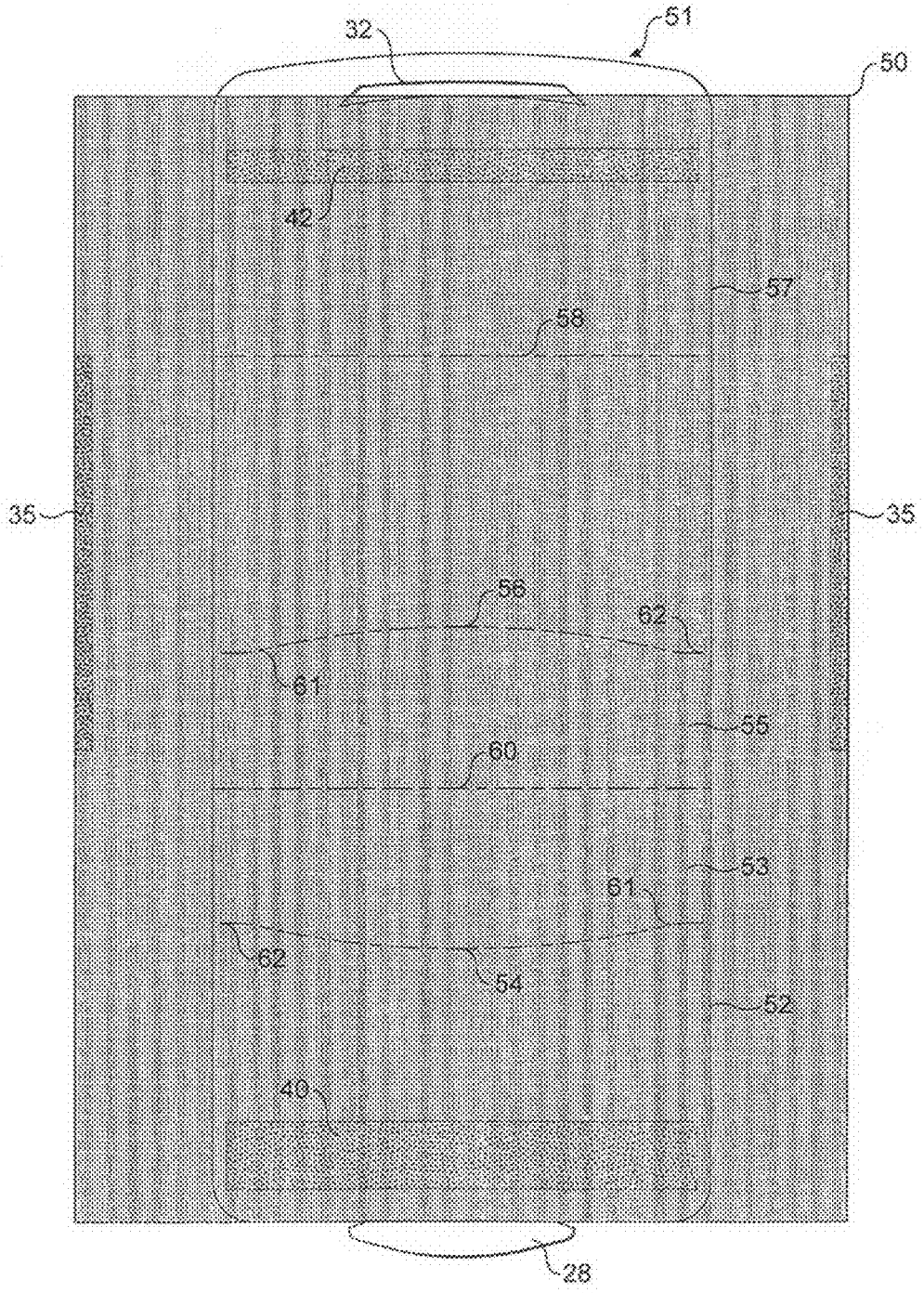
FIG. 6 is a front view of a second pack in flattened form.
Figure 8:
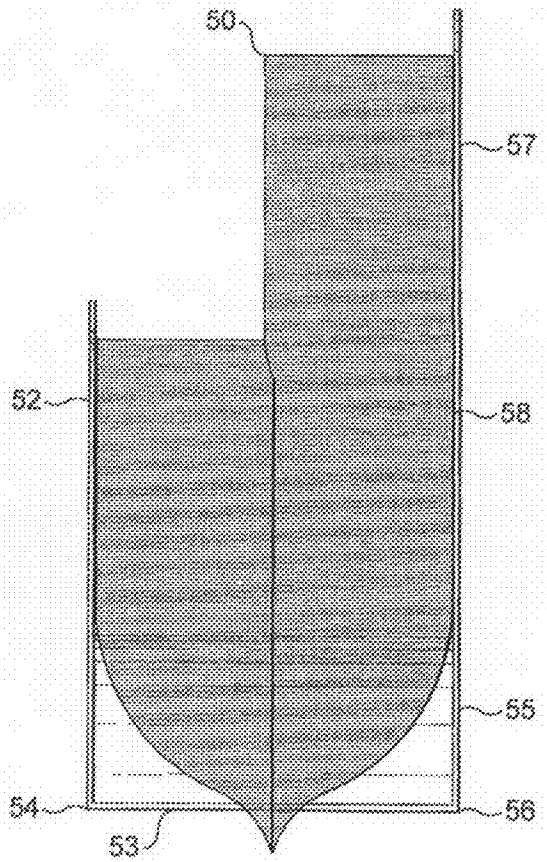
FIG. 8 is a side view of the opened out pack.
Figure 7:
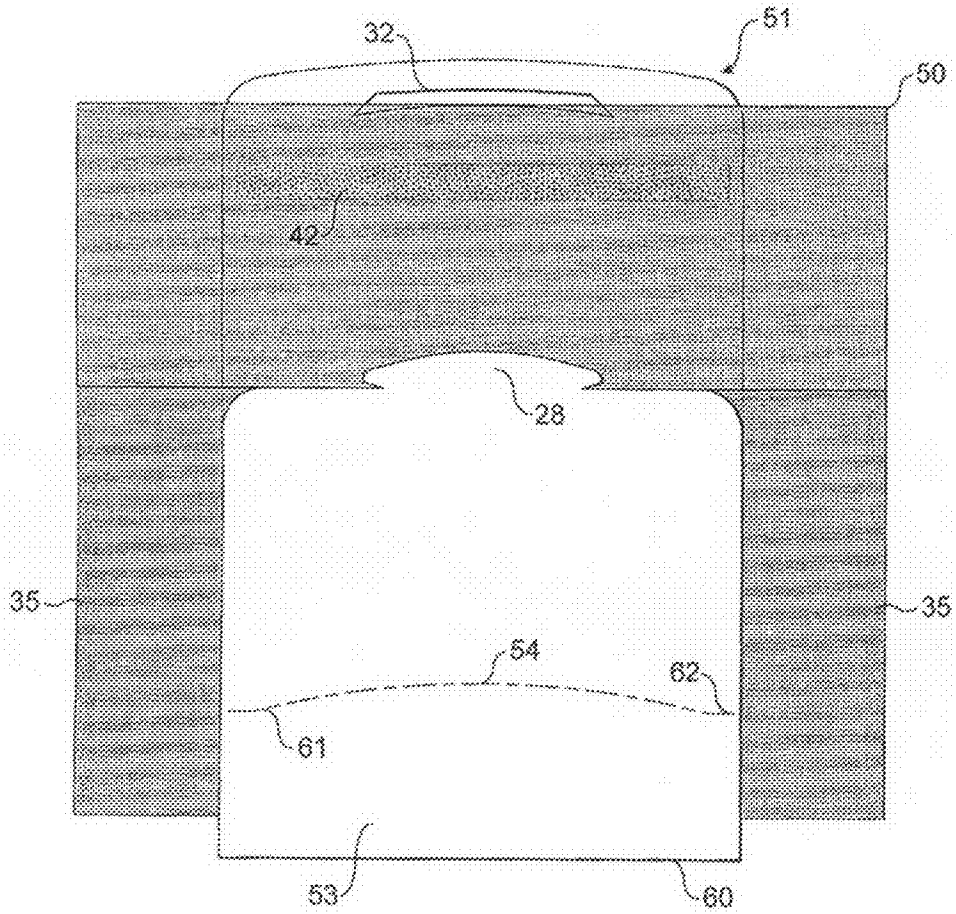
FIG. 7 is a front view of the pack of FIG. 6 opened out ready to receive a food item or items.
Figure 9:
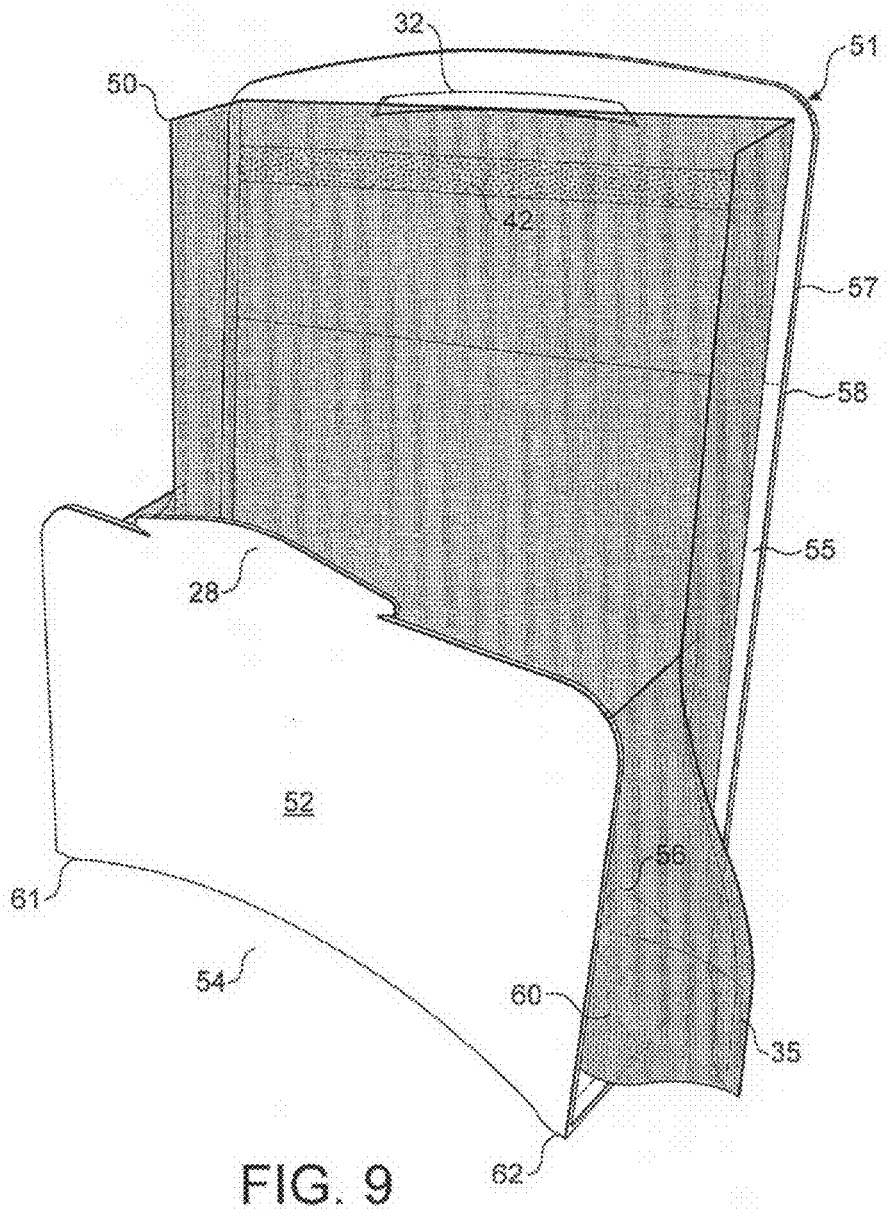
FIG. 9 is a perspective view of the opened out pack with the lid open.
Figure 10:
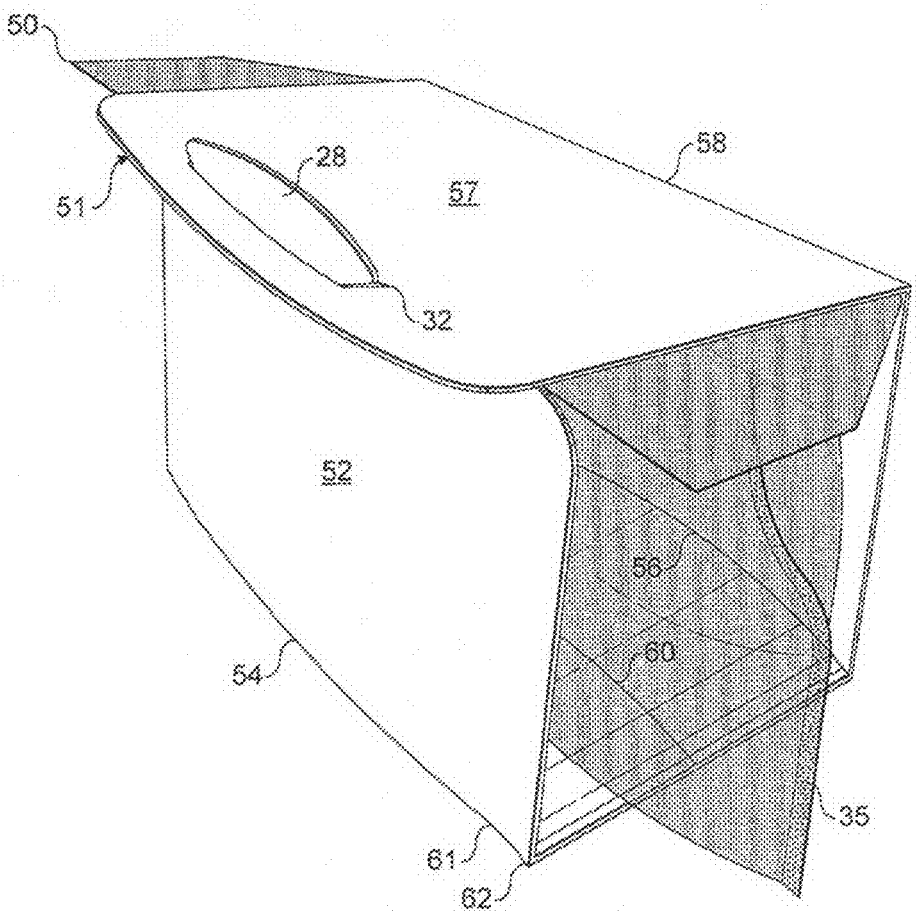
FIG. 10 is a perspective view of the pack with the lid closed.

The bottom wall 14 of the holder has a central fold line 21 and intermediate fold lines 22, 23 located midway between the central fold line and the fold lines 13, 16 between the base and front and rear walls of the holder respectively. The base and the bottom wall of the holder can thus be folded into generally convex shape as shown in FIG. 3 to sit comfortably in the palm of the hand whilst the food item is being consumed.

The lid 17 of the container is similarly formed with a central fold line 24 and intermediate fold lines 25 and 26 to enable the lid to be formed into a convex or concave shape as required.

The lid 19 of the holder has a wide dovetail shaped undercut tab 28 formed by a slit 29 in the lid and the lid is formed with a fold line 30 extending across the lid at the base of the tab to enable the tab to be readily turned out of the lid. The front wall 12 of the holder has an elongate slit 32 in which the tab can be locked when the lid is folded over the top of the bag to close the holder.

The bag as indicated earlier is located in the holder and is somewhat wider than the holder so that it projects from either end of the holder. The bag is formed from a folded over sheet of paper with a seam 35 between the overlapping edges of the bag. The seam does not extend to the top of the bag leaving the front and rear walls of the bag free to be separated to enable the bag to be readily opened for insertion of a food item and removal of the food item. The front and rear walls of the bag are adhered by elongated adhesive patches 40 to the inside front and rear walls of the holder towards the upper ends of those walls. In addition the back wall of the bag which extends over the lid 17 and part way over the closure flap 19 is adhered to the closure flap by an elongate patch of adhesive 42. The back wall of the bag thus opens and closes when opening and closing of the lid/closure flap. Because the front wall of the bag is somewhat shorter than the back wall, the front wall can readily be folded down to provide easy access to the contents of the bag.

When a food item has been inserted in the bag the lid of the bag is folded downwardly over the bag and the tab from the closure flap is tucked into the slot to lock the lid in the closed position.

The multiple folded base and lid of the container permit the container to fold into a shape adapted to suit the food product in the bag. The central region of the base can be pressed upwardly between the side walls of the bag to separate the side walls of the holder and thereby the front and rear walls of the bag secured to the holder walls.

Reference is now made to FIGS. 6 to 10 of the drawings which show an alternative embodiment. In this case the folded paper bag indicated at 50 is supported in a one-piece holder formed from a strip of card indicated at 51. The holder comprises a front wall 52 and bottom wall 53 hinged by a fold line 54 to the front wall, a back wall 55 hinged by a fold line 56 to the bottom wall and a lid 57 hinged by a fold line 58 to the back wall.

The bottom wall of the holder has a central fold line 60 and the fold lines between the bottom wall and front and rear side walls of the holder are convexly curved with respect to the central fold line of the base so that as the base is unfolded the side walls of the holder move apart and become convexly curved as they follow the fold lines with the base. As the centre of the base moves between the front and rear walls of the holder, the base goes "over centre" and adopts a position in which the front and rear walls of the holder are supported by the base in a stable condition.

The end regions of the convexly curved fold lines between the base and side walls have short reverse curve portions 61 and end in a straight parallel portions 62. The resulting corners between the base and side walls of the holder form stable seatings for the holder on the surface.

As with the first embodiment, the bag projects on either side of the holder and the front and rear walls of the bag are secured to the front and rear walls of the holder by elongate lines of adhesive. The rear wall of the bag extends over the lid and is adhered to the lid adjacent its upper end.

The front wall of the holder is formed along its upper edge with an undercut wide dovetailed shaped tab and the lid of the holder is formed with a corresponding slot in which the tab can lock to hold the lid down and thereby hold the food container closed.

The invention claimed is:

1. A pack for holding a food item or items, comprising a bag having a pair of sides joined at opposing edges by a respective seam, and a channel shaped holder for the bag formed in card and comprising a pair of side walls to which the sides of the bag are adhered, and a base hinged at first fold lines to the side walls, one side wall of the holder being extended to provide a lid having a fold line with the top of the side wall to enable the lid to be folded over the top of the holder to close the upper end of the bag disposed within the holder, the lid terminating in a flap having a fold line with the lid to enable the flap to be folded downwardly along the other side wall of the channel and means being provided for securing the flap to the other side wall to hold the lid closed over the channel, characterized in that the base of the holder has a plurality of spaced second fold lines extending parallel to the first fold lines to allow the base to take up a generally convex or concave shape with the side walls of the holder spaced apart to hold the side walls of the bag apart; in that the side of the bag adjacent the side wall of the holder on which the lid is formed extends further than the other side of the bag over the underside of the lid to which it is adhered to fold over the top of the bag with the lid; and in that the other side of the bag extends above the side wall to which it is adhered to provide a flap which can be folded over the contents of the bag when the bag is closed by the lid.

2. A pack as claimed in claim 1, wherein the second fold lines in the base comprise a central fold line and intermediate fold lines disposed midway between the central fold line and the first fold lines are provided so that the base can take up a generally even convex or concave shape between the side walls of the holder.

3. A pack as claimed in claim 1 or claim 2, wherein the bag when flat is longer than the channel and is secured in the channel with portions of the bag extending beyond either end of the channel.

4. A pack as claimed in claim 1, wherein the means to hold the flap of the lid in engagement with an opposite side wall of the channel comprise a tab on the flap which is shaped to engage and lock in a slot in said other side wall.

5. A pack as claimed in claim 4, wherein the tab is formed within the perimeter of the flap by a slit in the flap.

6. A pack as claimed in claim 4 or claim 5, wherein the lid is formed with a plurality of spaced fold lines to enable the lid to adopt a generally convexly curved form.

7. A pack as claimed in claim 6, wherein the lid has a central fold line extending parallel to the fold lines between the lid and side wall and the lid and intermediate fold line on either side of the central fold line.

* * * * *